US006817306B2

(12) United States Patent
Nakata

(10) Patent No.: US 6,817,306 B2
(45) Date of Patent: Nov. 16, 2004

(54) THREAD CUTTING DEVICE FOR SEWING MACHINE

(75) Inventor: Masahiro Nakata, Toyonaka (JP)

(73) Assignee: Yamato Sewing Machine Seizo Co., Ltd., Osaka-fu (JP)

( * ) Notice: Subject to any disclaimer, the term of this patent is extended or adjusted under 35 U.S.C. 154(b) by 0 days.

(21) Appl. No.: 10/385,110

(22) Filed: Mar. 10, 2003

(65) Prior Publication Data

US 2003/0196579 A1 Oct. 23, 2003

(30) Foreign Application Priority Data

Mar. 8, 2002 (JP) ..... 2002-111361

(51) Int. Cl.[7] ..... D05B 65/06
(52) U.S. Cl. ..... 112/298
(58) Field of Search ..... 112/285, 288, 112/289, 291, 295, 298, 260; 83/910, 938

(56) References Cited

U.S. PATENT DOCUMENTS 104,561 A * 6/1870 Crowe ..... 30/296.1
757,463 A * 4/1904 Hogan ..... 112/298
771,653 A * 10/1904 Matthews ..... 112/298
1,145,175 A * 7/1915 Weiss ..... 112/260
2,345,943 A * 4/1944 McCann ..... 112/296
5,337,688 A * 8/1994 Arima ..... 112/298
5,778,809 A * 7/1998 Schips ..... 112/287

* cited by examiner

*Primary Examiner*—Ismael Izaguirre
(74) *Attorney, Agent, or Firm*—D. Peter Hochberg; Sean Mellino; Katherine R. Vieyra

(57) ABSTRACT

Provided is a thread cutting device for sewing machine used when the operator performs a sewing operation while inserting an elastic cord in a circular part of a sewing object such as a waist part of underwear. When the sewing operation is completed, a moveable thread guard member and a thread nip member nip a cut end of a looper thread cut by an existing thread cutting device. With a fabric feed immediately after the next following sewing operation is started in this state, part of a looper thread hanging between a nip position of the cut end and the fabric is cut under sliding contact at a location extremely adjacent to the starting position of seams by using a cutting edge, facing to a needler location, of a blade fixed to a throat plate. This permits a remarkable reduction in the length of the looper thread end remaining at the starting position of the seams.

9 Claims, 8 Drawing Sheets

THREAD CUTTING DEVICE FOR SEWING MACHINE

BACKGROUND OF THE INVENTION

1. Field of the Invention

The present invention relates to a thread cutting device for sewing machine used when a sewing operation is performed while inserting an elastic cord in a circular part of a sewing object such as a waist part of underwear.

2. Description of the Background Art

Referring to FIG. 10, for example, in the case that the operator performs a sewing operation while inserting an elastic cord into a waist part (circular part) 51 of a sewing object 50, such as underwear, by using a multi-needle sewing machine, the operator performs the sewing operation while moving the waist part 51 in a direction indicated by arrow A, in the state that the edge of a looper thread is held by a looper thread end holder disposed in the inside of a sewing bed. As the result, a plurality of seams 52 are formed throughout the periphery of the waist part 51.

In this sewing operation, at the completion of the sewing throughout the periphery of the waist part 51, the looper thread is hung on a thread guard part disposed at the tip of a movable thread guard member moved to the underside of an needle location. With the retraction of the movable thread guard member in this state to a side orthogonal to a sewing direction with respect to the needle location, the looper thread hung on the thread guard part is pulled into a preset position and then cut at this setting position by mutually contact action between the movable thread guard member and a stationary blade member, and the vicinity of a cutting edge of the looper thread is nipped between the movable thread guard member and a thread nip member in the looper thread end holder, then entering the state of waiting for the next following sewing operation.

In the sewing machine provided with the above-mentioned thread cutting device, a looper thread end 52*c*, so-called "fluff," remains (normally, as long as about 5 cm to 7 cm) at a starting position 52*a* of the seams 52, because the next sewing operation is started in the state that the vicinity of a cut end of the looper thread is nipped between the movable thread guard member and thread nip member. In order to eliminate such a long looper thread end 52*c*, i.e., fluff, the operation must cut off by manual operation with scissors etc every time the sewing operation is completed. This manual operation is time consuming, thereby lowering the sewing efficiency and increasing the sewing cost. In addition, there is the problem of imposing on the operator the serious burden if the operator continuously sews a large number of sewing objects one after another.

It can be considered that in order to omit the operation of fluff removal, part of the remaining long looper thread end 52*c* is sewed into the seams 52 in the following manner that the staring position 52*a* and a termination position 52*b* of the seams 52 are sewed one over the other. However, in this manner, the looper thread end 52*c* is extremely unstable and likely to drift during the time of sewing, failing to exactly match the seams 52. This produces a poor finish on the sewing product, leading to non-conforming article. Consequently, the fluff is usually removed by manual cutting that is time consuming and imposes on the operator the serious burden.

As means for omitting such fluff removal by manual cutting, there have been proposed the followings.

Firstly, in a device disclosed in Japanese Patent Publication No. 7-34838 (hereinafter referred to as "device X", concurrently with, alternatively, immediately after a sewing operation is started in the state that the vicinity of a cut end of a looper thread is nipped by a movable thread guard member and a thread nip member that constitute a lower thread (looper thread) retainer, the cut end of a looper thread is pulled into seams so as to reduce the edge length of the looper thread projecting from the starting position of the seams in the following manner that a stationary blade member and thread nip member are further retracted in a direction in which they depart from a setting position retracted to a side of a needle location with respect to the needle location, in order to release the nipping of the looper thread cut end by the movable thread guard member and thread nip member.

Secondly, in a device disclosed in Japanese Patent Unexamined Publication No. 1-290571 (hereinafter referred to as "device Y"), concurrently with, alternatively, immediately after a sewing operation is started, a cut end of a looper thread is pulled into seams and the edge length of the looper thread projecting from the starting position of the seams is reduced in the manner that a movable thread guard member is allowed to approach a needle location side by a predetermined amount in order to release nipping of the looper thread cut end by the movable thread guard member and a thread nip member.

With a conventional thread cutting device for sewing machine having the construction as shown in device X or device Y, the fluff removal by manual cutting can be omitted by reducing the length of the looper thread end projecting and extending from the starting position of the seams. However, to device X, in addition to the functions required for a thread cutting device, such as the cutting of a looper thread when a sewing operation is completed; and the nipping of a looper thread end so cut, in preparation for the next following sewing operation, it is necessary to add the following special functions that the nipping of the cut end of the looper thread is released concurrently with or immediately after the sewing operation is started, and that in order to apply tension to the cut end and pull the edge of the looper thread into the seams, the stationary blade member and thread nip member are further retracted in a direction in which they depart from their respective setting positions with respect to the needle location, while the movable thread guard member is maintained in its setting position. It is therefore necessary to convert an existing thread cutting device throughout its structure, thereby complicating the structure and increasing the cost of the device.

In device Y, an existing thread cutting device can be used as it is. Further, the structure of device Y is simpler than that of device X, and it is easy to reduce the cost. It is however necessary to add to the existing thread cutting device such a construction that only the movable thread guard member is moved so as to approach the needle location side by a predetermined amount while the stationary blade member and thread nip member are maintained at their setting positions. Therefore, an increase in the cost of the device is unavoidable.

Additionally, the conventional thread cutting devices, such as device X and device Y, are of the type in which the nipping of the cut end of the looper thread is released at a position away from the side of the needle location, in order to pull the cut end into the seams. It is therefore unavoidable that a looper thread having a considerable length (i.e., fluff) remains and projects beyond the starting position of the seams, although no manual cutting may be required. A further reduction in the length of the remaining thread is therefore desired in the case of quality sewing product, and depending on the type of the sewing product.

SUMMARY OF THE INVENTION

It is an object of the present invention to provide a thread cutting device for sewing machine that can considerably reduce the length of a looper thread end remaining at a starting position of seams merely by adding a very simple construction to an existing thread cutting device.

According to a first aspect of the present invention, in a thread cutting device for sewing machine including a thread cutting device that immediately after a sewing operation is completed, cuts a looper thread after pulling it into a setting position located at a side orthogonal to a sewing direction with respect to a needle location of a throat plate, there is provided a nip means for temporally nipping and holding a cut end of the looper thread cut by the thread cutting device, in the vicinity of the setting position. A blade is fixed to the throat plate in a state that a cutting edge of the blade is faced to the needle location. The blade can cut, under sliding cont, a portion of the looper thread that is hung over between the nip means and the fabric with the feed of fabric immediately after a sewing operation is started in such a state that the cut end is nipped and held by the nip means.

With this construction, immediately after sewing operation is completed, the looper thread pulled into the setting position at a side of the needle location is cut by the thread cutting device, and the cut end of the looper thread so cut is temporarily nipped and held in the vicinity of the setting position by the nip means. When a sewing operation is started in this state and a fabric is fed, a portion of the looper thread hung over between the nip means and the fabric is cut under sliding contact by the cutting blade edge of the blade fixed to the throat plate, which faces to the needle location. Thus, the looper thread cutting immediately after the sewing operation can be performed by using the existing thread cutting device conventionally provided in sewing machines. On the other hand, when a portion of the looper thread hung over between the fabric and the nip means in the vicinity of the setting position is cut immediately after the next following sewing operation is started, it can be cut under sliding contact at a location extremely adjacent to the starting position of the seams by using the cut end facing to the needle location in the blade fixed to the throat plate. It is therefore possible to considerably reduce the length of the looper thread end remaining and projecting beyond the starting position of the seams, thereby eliminating fluff disposal by the operator's manual cutting every time the sewing operation is completed. Further, unlike device X and device Y, there is no need for adding any additional function to the thread cutting device in order to reduce the length of the looper thread end remaining at the sewing start position. Only necessary work is to fix the blade to the throat plate. Therefore, as compared to device X and device Y, the overall construction of the device can be more simplified to reduce the cost.

According to a second aspect of the present invention, in a thread cutting device for sewing machine including (i) a movable thread guard member having at its tip a thread guard part that immediately after a sewing operation is completed, travels to the underside of a rectile location of a throat plate and picks a looper thread, the movable thread guard member retracting the thread guard part to a side orthogonal to a sewing direction with respect to the needle location and pulling the looper thread picked by the thread guard part into a setting position; (ii) a stationary blade member for cutting the looper thread pulled into the setting position by the movable thread guard member, under mutually sliding contact action with the thread guard part; and (iii) a thread nip member for nipping the vicinity of a cutting edge of the looper thread cut by the movable thread guard member and the stationary blade member, between the movable thread guard member and the thread nip member. In this thread cutting device, a blade is fixed to the throat plate in such a state that a cutting edge of the blade is faced to the needle location. The blade can cut, under sliding contact, a portion of the looper thread that is hung over between a fabric and the nipped cut end with the feed of fabric immediately after a sewing operation is started in such a state that the vicinity of the cut end of the looper thread is nipped between the movable thread guard member and the thread nip member.

With this construction, immediately after the sewing operation is completed, the movable thread guard member travels to the underside of the needle location and then retracts to a side orthogonal to the sewing direction in the state that the looper thread is hung on the thread guard part disposed at the tip of the movable thread guard member. Thereby, the looper thread is pulled into the setting position on a side of the needle location and then cut by the mutually sliding contact action between the thread guard part and the stationary blade member, and the cut end of the looper thread so cut is nipped and held between the movable thread guard member and thread nip member, in the vicinity of the setting position. When the sewing operation is started in this state and the fabric is fed, a portion of the looper thread hung over between a fabric and a nip position determined by the movable thread guard member and thread nip member is cut under sliding contact by the cutting blade edge of the blade fixed to the throat plate, which faces to the needle location. Thus, the cutting of the looper thread immediately after the sewing operation and the nipping of the cut end are performed by the movable thread guard member, stationary blade member and thread nip member, all of which are included in the existing thread cutting device of the conventional sewing machine. On the other hand, when a portion of the looper thread hung over between the nipped cut end and the fabric is cut immediately after the next following sewing operation is started, as in the case with the first aspect of the present invention, it can be cut under sliding contact at a location extremely adjacent to the starting position of the seams by using the cutting edge, facing to the needle location, of the blade fixed to the throat plate. It is therefore possible to considerably reduce the length of the looper thread end remaining and projecting beyond the starting position of the seams, thereby eliminating fluff disposal by the operator's manual cutting every time the sewing operation is completed. Further, unlike device X and device Y, there is no need of adding any components for performing additional functions to the existing thread cutting device, in order to reduce the length of the looper thread end remaining at the sewing start position. Only necessary work is to fix the blade to the throat plate. Therefore, as compared to device X and device Y, the overall construction of the device can be more simplified to reduce the cost.

According to a third aspect of the present invention, the construction of the second aspect is usefully applicable to a thread cutting device for multi-needle sewing machine in which a plurality of needle locations in a throat plate are disposed in parallel in a direction orthogonal to a sewing direction, and a plurality of loopers corresponding to these needle locations are reciprocally movable in the direction orthogonal to the sewing direction. That is, in the case of so-called transverse looper type multi-needle sewing machine in which a plurality of loopers move reciprocally in a direction orthogonal to the sewing direction, there is a large distance between the needle location and a setting position at which the thread cutting device is retracted to a side away from the range of the loopers. This therefore increases the length of the looper thread hung over between the fabric and a nip position of the cut end of the looper thread. Even if added such a function as described in device X or device Y, there are limits to a reduction in the length of the looper thread end remaining. Whereas in the present invention, the cutting is executed at a locating facing to the needle location of the throat plate, so that the length of the looper thread end remaining can be reduced remarkably even in the transverse looper type multi-needle sewing machine.

According to a fourth aspect of the invention, in a thread cutting device, the cutting blade edge of the stationary blade is disposed, for example, so as to obliquely cross a needle location having a slender slot shape, and the cutting blade edge has a cutting width to tear a hang portion of the looper thread while the hang portion is allowed to slide along the cutting blade edge.

With this construction, the looper thread can be cut reliably, although the stationary blade tears it.

According to a fifth aspect of the invention, a thread cutting device includes a cut looper thread disposer having a thread suction device that sucks and holds, at a predetermined position before and after cutting, a portion of the looper thread to be cut by the stationary blade, and a thread pick and pull device that picks the portion of the looper thread and pulls it into a vicinity of a suction port of the thread suction device.

With this construction, the stationary blade can cut a plurality of looper threads collectively and reliably, without failing to cut some of the looper threads. In addition, waste thread occurred during the time of cutting can be sucked and collected into a specific location, so that the recovered waste thread is discarded.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
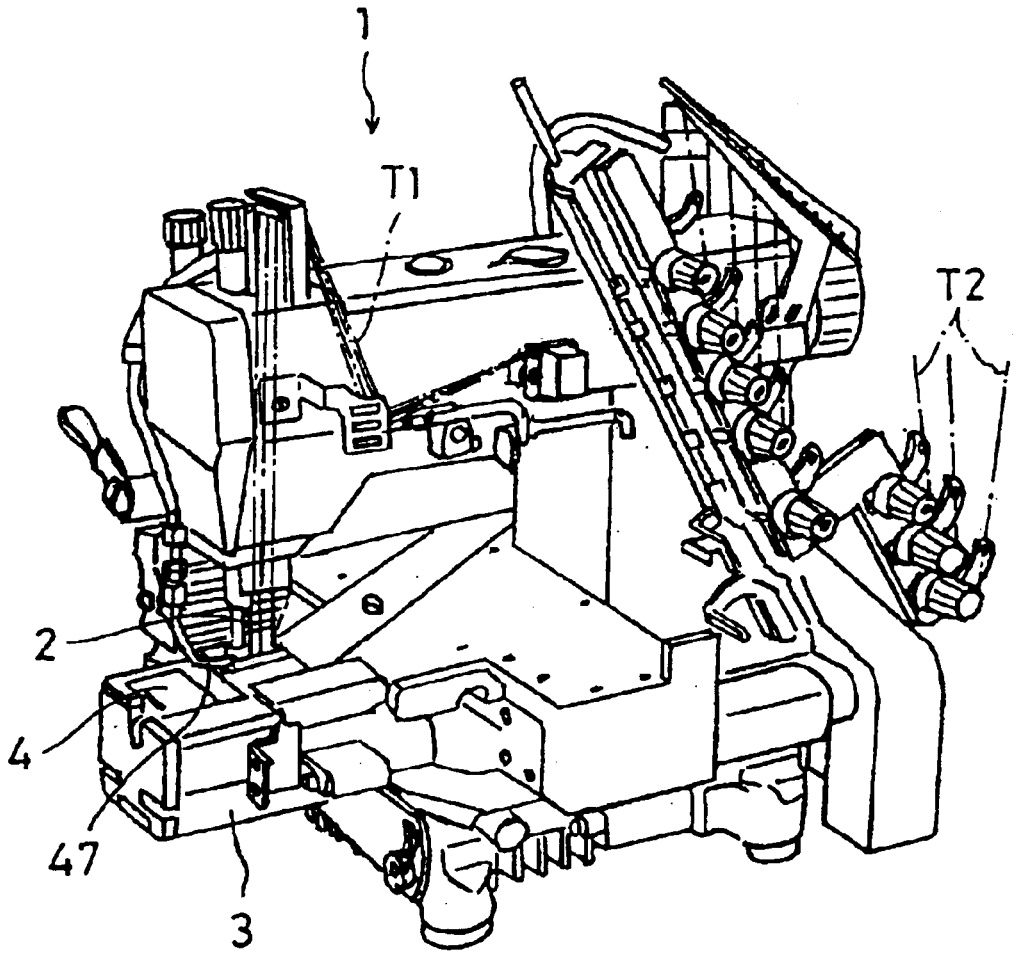
FIG. 1 is a perspective view roughing the appearance of a multi-needle sewing machine to which the present invention is applied.
Figure 2:
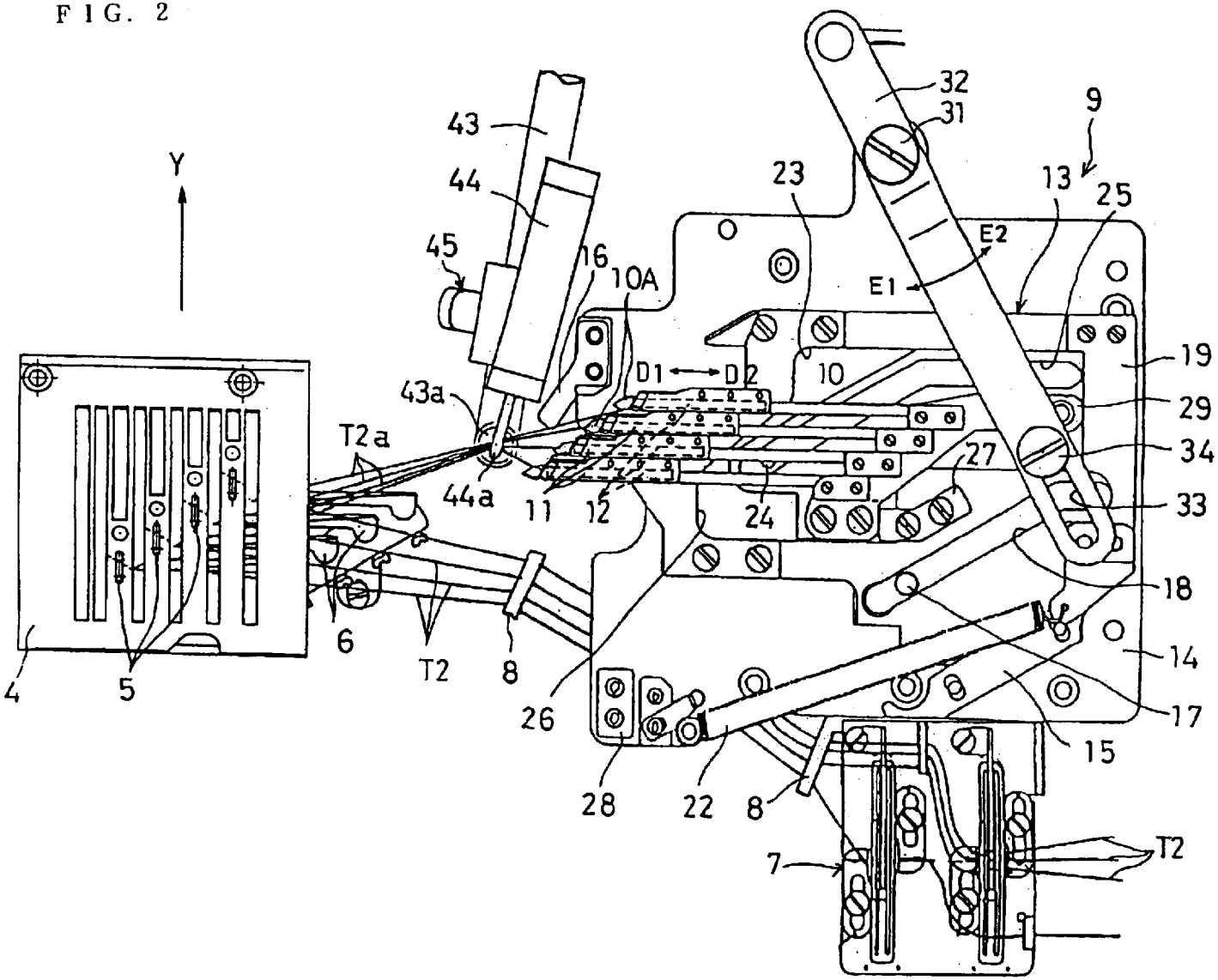
FIG. 2 is an enlarged plan view showing important parts in the state that a plurality of loop threads cut by a thread cutting device of the multi-needle sewing machine are nipped and their respective portions of a looper thread are collected.
Figure 5:
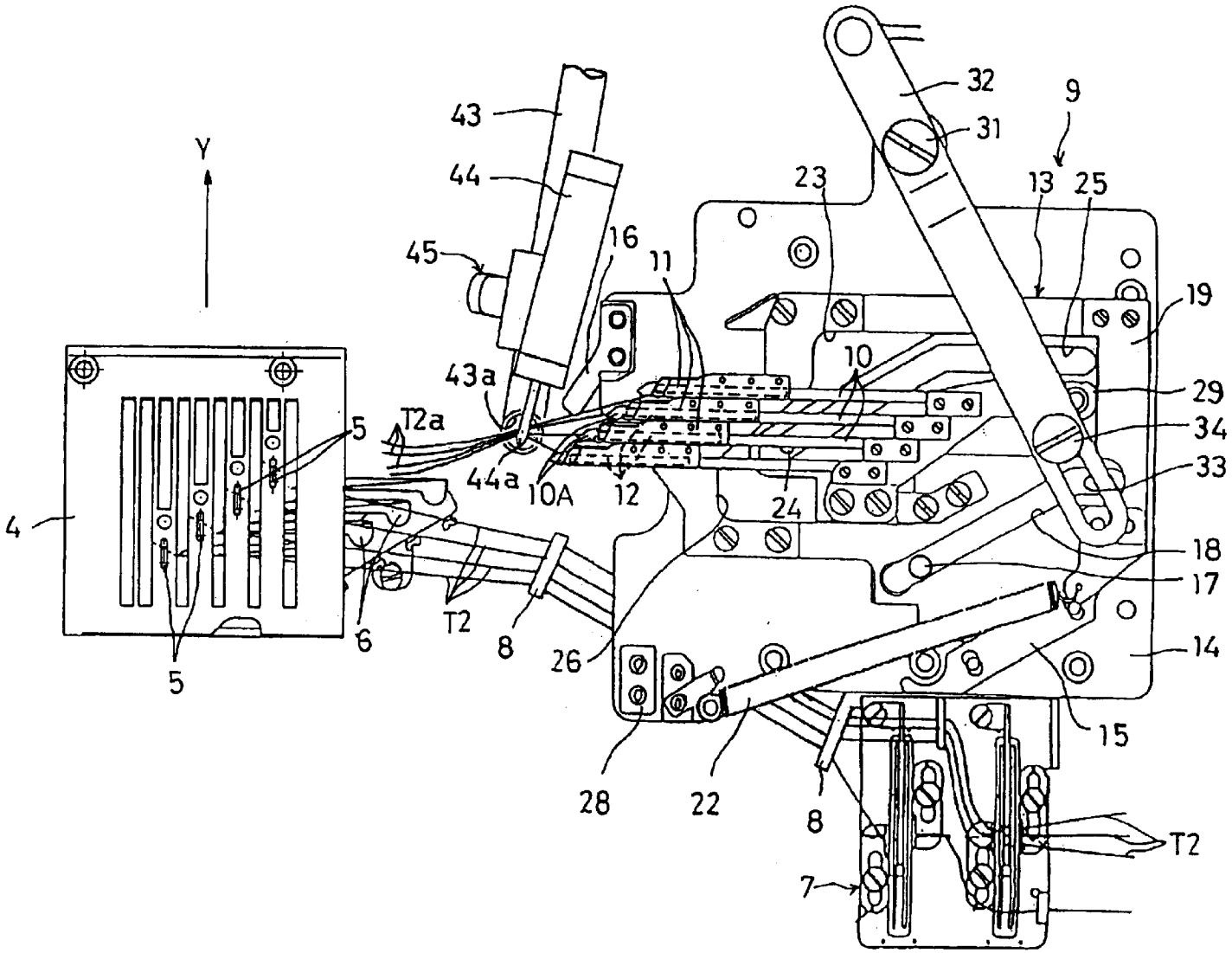
FIG. 5 is an enlarged plan view of important parts illustrating a state the part of the looper thread is cut by the blade.
Figure 10:
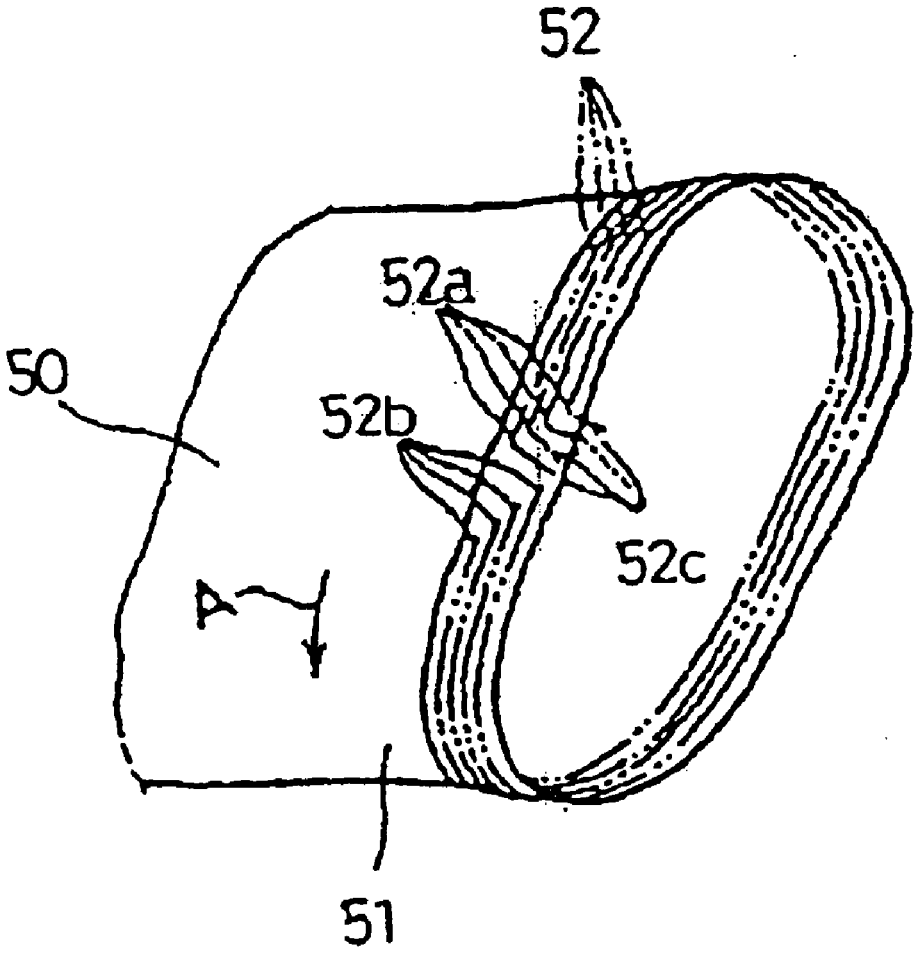
FIG. 10 is a perspective view illustrating the operation of sewing a circular part.

FIG. 1 is a perspective view roughing the appearance of a multi-needle sewing machine to which the present invention is applied. FIG. 2 is an enlarged plan view showing a thread cutting device in the multi-needle sewing machine. A multi-needle sewing machine 1 has a plurality of needles 2 (for example, four needles are shown in the figure) in a direction orthogonal to a sewing direction Y. The needles 2 through which an upper thread (needle thread) T1 is passed are reciprocally movable up and down along a vertical motion path. The needles 2 with the needle thread T1 descend passing through a plurality of slot-like needle locations 5 that are disposed in parallel to a direction orthogonal to the sewing direction Y on a throat plate 4 fixed to a sewing machine bed 3, and the needle thread T1 is caught by a plurality of loopers 6 (see FIGS. 2 and 5) which are disposed below the corresponding needle locations 5. The needle thread T1 is engaged with a looper thread T2 to be fed below the sewing machine bed 3 in synchronization with climb motion of the needles 2, and seams 52 are formed on, for example, a waist part 51 of a sewing object 50, so as to circularly sew up an elastic cord etc between the seams 52, as shown in FIG. 10.

The loopers 6 is of transverse type that is reciprocally movable in a direction orthogonal to the sewing direction Y. The looper thread 2 is, as shown in FIG. 1 of 5, fed to the loopers 6 through a looper thread guide cam device 7 and a plurality of looper thread paths 8. The multi-needle sewing machine 1 includes a thread cutting device 9 for automatically cutting the looper thread T2 fed to the loopers 6 when a sewing operation is completed. Following is the construction of the thread cutting device 9.

Specifically, the thread cutting device 9 basically has its tip part a thread guard part 10A on which the looper thread T2 is hung, and includes a movable thread guard member 10, a stationary blade member 11, and a thread nip member 12. The movable thread guard member 10 can be switched between (i) a state that it moves to the underside of the needle location 5 immediately after sewing operation and hangs the looper thread T2 on the thread guard part 10A, and (ii) a state that it retracts to a side orthogonal to the sewing direction Y from the underside of the needle location 5, and pulls the looper thread T2 hung on the thread guard part 10A into a preset position (see FIG. 2). The stationary blade member 11 is disposed adjacent to the upper surface side of the movable thread guard member 10 such that the looper thread T2 pulled into the setting position by the member 10 is cut by mutually slide contact action with the thread guard part 10A. The thread nip member 12 (designated by dotted lines in FIGS. 2 and 5) is formed by a plate spring that is elastically in contact with the bottom surface side of the movable thread guard member 10 in order to nip the proximity of a cut end of the looper thread T2 between the movable thread guard member 10 and the thread nip member 12. There is provided a thread cut and nip means 13 that can elastically shift the stationary blade member 11 and thread nip member 12 to the setting position when retracting to the side of the movable thread guard member 10.

The thread cut and nip means 13 is mounted on the upper surface of an approximately rectangular base 14 secured horizontally, and has a frame-like stationary blade amount 19. The blade mount 19 is slidingly displaceable between (i) direction D1 in which it approaches the needle location 5 up to a position to be restricted by a stationary blade mount stopper 28, and (ii) direction D2 in which it departs from the needle location 5, through blade mount guides 15, 16 fixed to the base 14, an axis member 17, and an inclined guide slot 18 formed so as to engage in the axis member 17. The stationary blade member 11 is fixed on the upper surface of the front-end side of the frame-like stationary blade mount 19, and the thread nip member 12 is fixed on its bottom surface. The blade mount 19 is movably urged in direction D1 through a spring 22 stretched between the blade mount 19 and base 14.

The movable thread guard member 10 is supported on the upper surface of the base 14 in the state of fitting in a groove 23 that is formed in the frame-like stationary blade mount 19 and has an approximately L-shape when viewed from above. The movable thread guard member 10 has a movable blade mount 29. The blade amount 29 is slidingly displaceable between (i) direction D1 in which it approaches the needle location 5 up to a position to be restricted by a stopper 26 formed on the stationary blade mount 19, and (ii) direction D2 in which it departs from the needle location 5, through an axis member 24 fixed to the base 14, and an inclined guide slot 25 that is parallel to the inclined guide slot 18 and is formed so as to engage in the axis member 24. The movable thread guard part 10 is fixed to a front-of-center upper surface of the movable blade mount 29, and one end part of an oscillating lever 32 is sequentially linked via a slot 33 and an axis member 34 to the back end of the movable blade amount 29. The oscillating lever 32 is pivoted, at its middle part in the longitudinal direction of the base 14, to an axis 31, and attached such that it can be rocked in directions indicated by arrows E1 and E2 by a double-action cylinder (not shown). By the rocking of the oscillating lever 32 with the expansion of the double-action cylinder, the movable blade mount 29 is driven to move to direction D1 and direction D2, so that the movable thread guard member 10 can be switched between the state of hanging the looper thread T2 on the thread guard part 10A, and the state of pulling the looper thread T2 so hung into the setting position.

Figure 3:
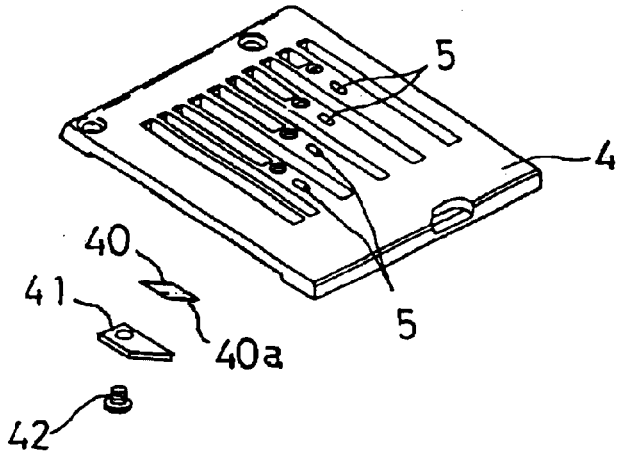
FIG. 3 is an enlarged disassembled perspective view of important parts illustrating a state that a blade is fixed to a throat plate.
Figure 4:
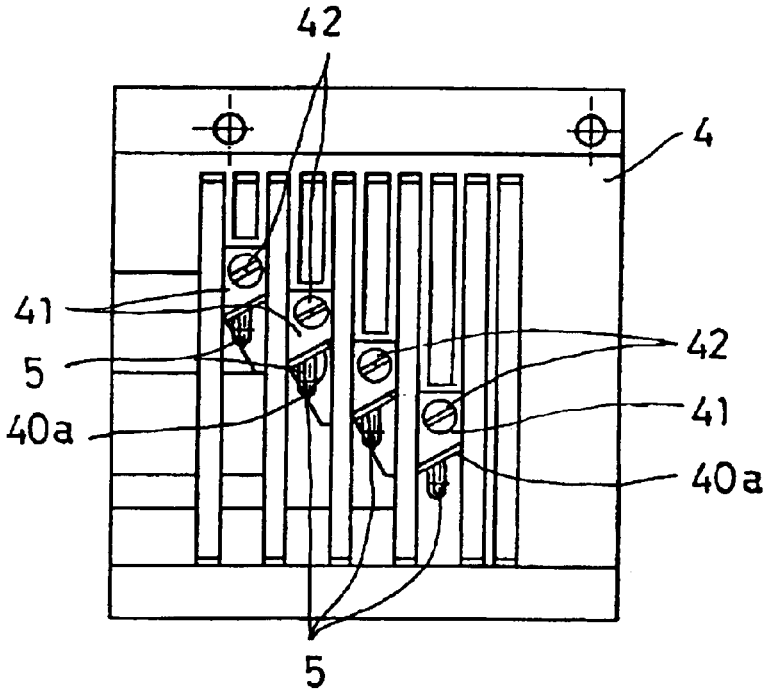
FIG. 4 is an enlarged bottom view of the throat plate to which the blade is fixed.
Figure 6:
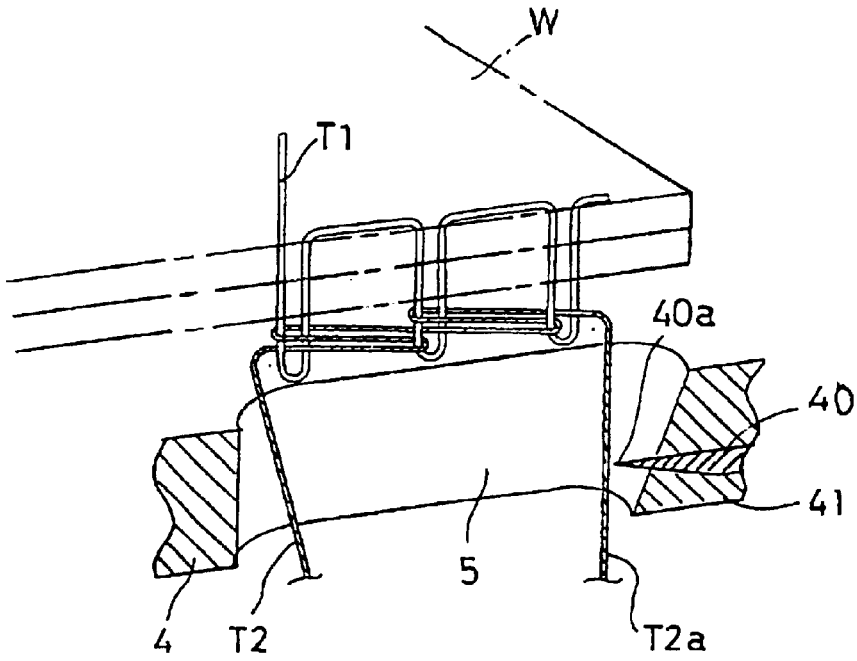
FIG. 6 is an enlarged vertical sectional view of important parts illustrating a situation around a needle location before the multi-needle sewing machine initiates sewing operation.
Figure 7:
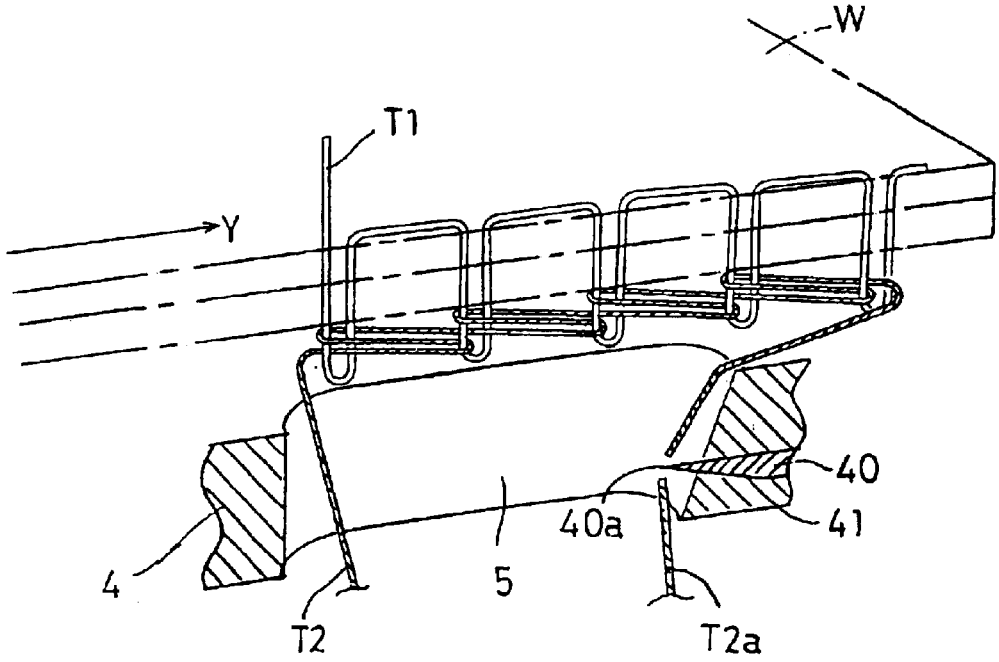
FIG. 7 is an enlarged vertical sectional view of important parts illustrating a situation around the needle location immediately after the multi-needle sewing machine initiates the sewing operation.

Referring to FIGS. 3 and 4, a thin blade 40 is fixed so as to be replaceable, through a blade keeper 41 and setscrew 42, to a location corresponding to the individual needle location 5 on the back surface of the throat plate 4. A cutting edge 40*a* of the thin blade 40 obliquely crosses the needle location 5, and its long cutting width faces to the needle location 5. With the initiation of sewing operation in the state that the cut end of the looper thread T2 cut by the cutting action of the thread cutting device 9 when the sewing operation is completed, is nipped between the movable thread guard member 10 and thread nip member 12, as shown in FIG. 6, a fabric W is fed in the sewing direction Y, as shown in FIG. 7. At this time, each blade 40 tears part of a looper thread 12*a* hanging between the fabric W and an edge nip position determined by the movable thread guard member 10 and thread nip member 12, while slidingly moving the part of the looper thread T2*a* along the cutting edge 40*a*.

Figure 8:
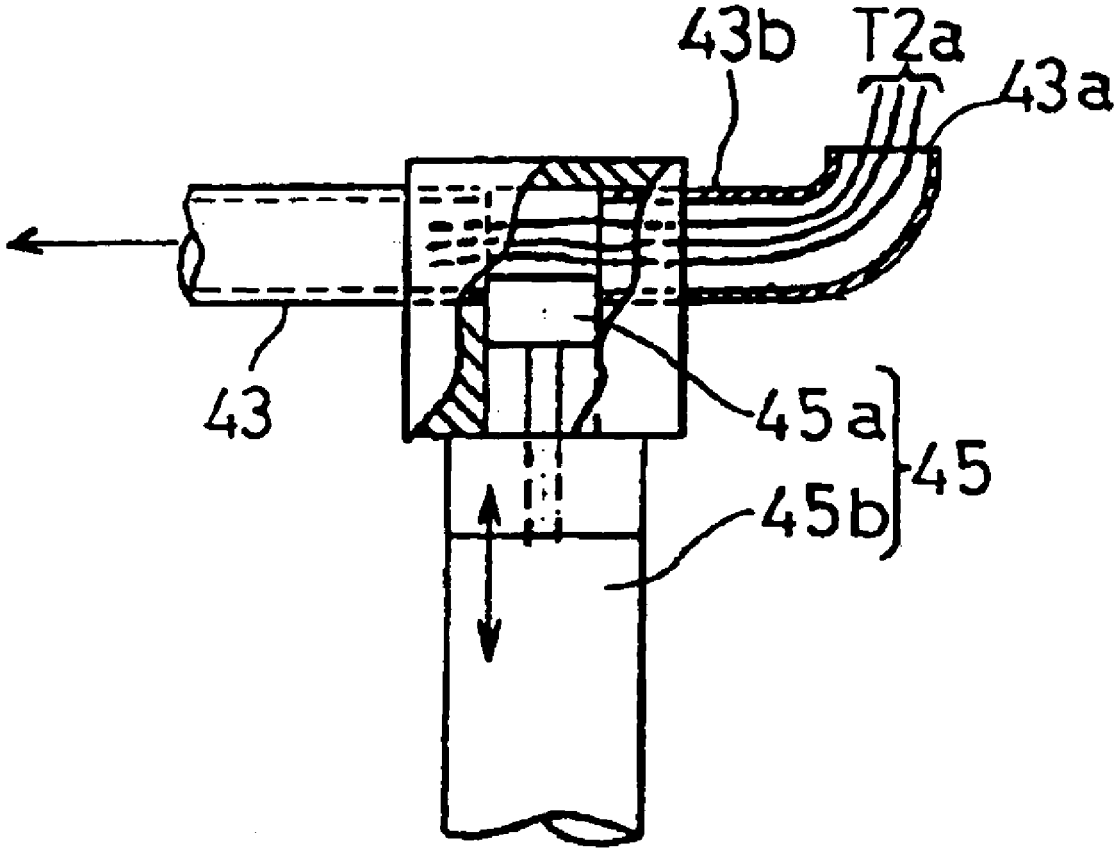
FIG. 8 is an enlarged side view of partially sectional important parts illustrating the operation of a thread suction tube and looper thread presser food in a cut looper thread disposal means added to the multi-needle sewing machine.

In addition to the above-mentioned construction, a cut looper thread disposal means is disposed at a side location of the needle location 5 orthogonal to the sewing direction Y. This disposal means includes a thread suction tube (thread suction device) 43, a thread pick and pull cylinder 44, and a looper thread presser foot 45. The thread suction tube 43 sucks and collects the part of the looper thread T2*a* cut by the stationary blade 40, at a single location, that is, in the vicinity of a suction port 43*a*, for a predetermined period of time before and after cutting. The thread pick and pull cylinder 44 picks at a pick part 44*a* part of the looper thread T2*a* and pulls it into the vicinity of the suction part 43*a* of the suction tube 43. As shown in FIG. 8, the looper thread presser foot 45 has a thread press member 45*a* that presses the part of the looper thread T2*a* to an internal wall 43*b* of the thread suction tube 43, and a cylinder 45*b* switches the thread press member 45*a* between a press position and a press release position.

An air blower 47 (see FIG. 1) is disposed at a location adjacent to the needle 2 above the throat plate 4. The air blower 47 blows up to the needle thread T1 by blowing out air at the same that the looper thread is cut.

Figure 9:
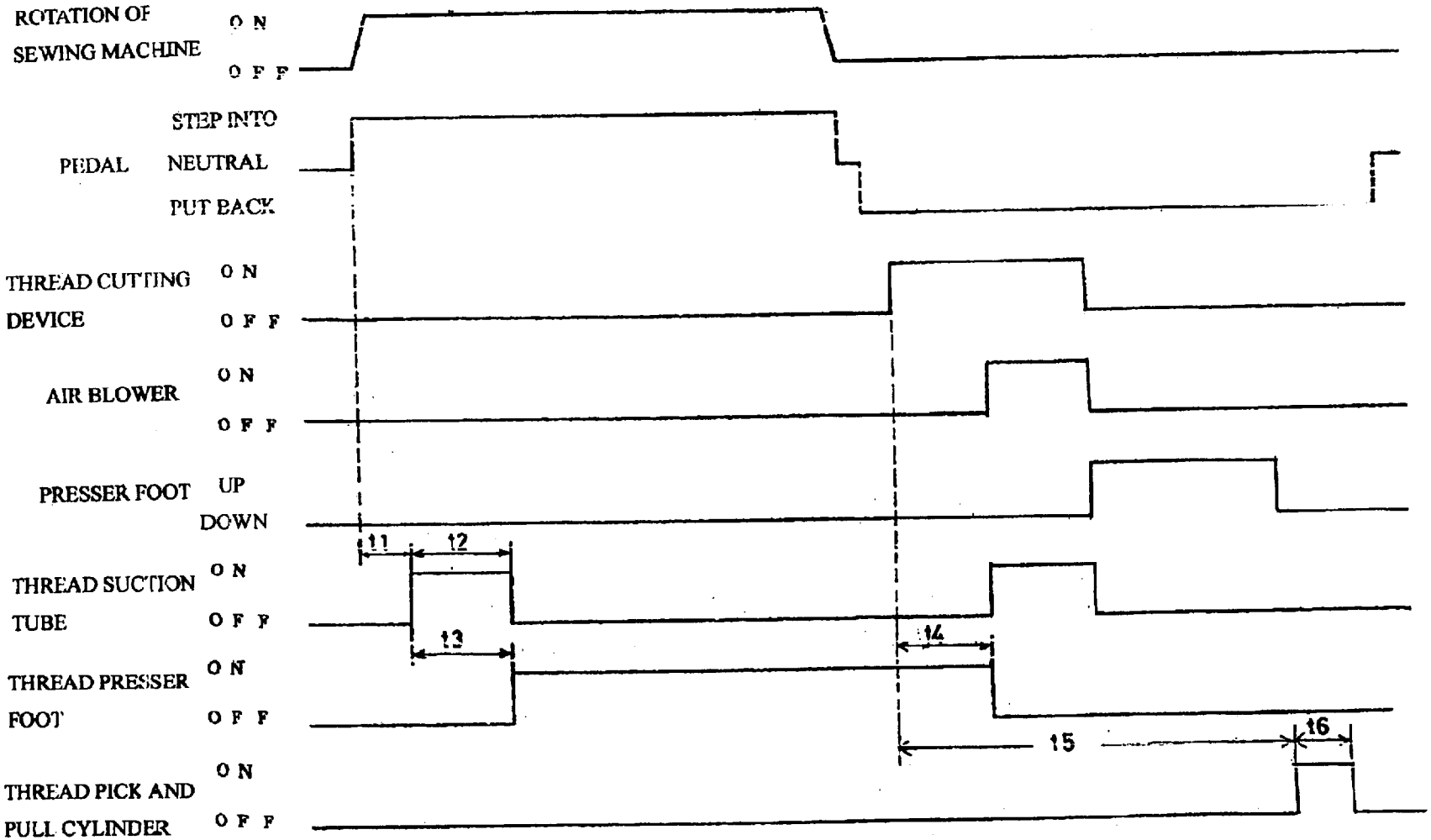
FIG. 9 is a timing chart illustrating the operation of a thread cutting device of the multi-needle sewing machine.

The operation of the thread cutting device for multi-needle sewing machine so constructed will be described by using a timing chart of FIG. 9 and by referring to FIG. 2, and FIGS. 5 to 7.

FIG. 2 shows the state the immediately after a sewing operation is completed, the moveable thread guard member 10 of the thread cutting device 9 travels to the underside of the needle location 5, and the looper thread T2 hanging on the thread guard part 10A is pulled into the setting position by the reaction of the movable thread guard member 10, the vicinity of the cut end of the looper thread T2 cut by mutually slide contact action of the thread guard member 10 and stationary blade member 11 is nipped between the movable thread guard member 10 and thread nip member 12; and the part of the looper thread T2*a* hanging between the nip location and fabric W is pulled into the vicinity of the suction port 43*a* of the thread suction 43 by the thread pick and pull cylinder 44 that acts for a setting time t6 after a setting time t5 is elapsed since the thread cutting device 9 is activated.

In this state, the sewing machine is rotated, and stepping into on pedal starts the next following sewing operation. After a setting time t1 is elapsed from the start of sewing operation, the thread suction tube 43 performs its suction action for a setting time t2. On the other hand, the thread press member 45*a* of the looper thread presser foot 45 is maintained at a presser foot release position until a setting time t3 is elapsed since the thread suction tube 43 is activated. At this point of time, that is, when the fabric W is fed in the sewing direction Y to some degree with the start of the sewing operation, as shown in FIG. 7, the part of the looper thread T2*a* is torn (cut) while slidingly moving along the cutting edge 40*a* of the blade 40 facing to the needle location 5 fixed to the throat plate 4, as shown in FIG. 8. The part of the looper thread T2*a* is sucked by the thread suction tube 43, and also pressed to and held on the internal wall 43*b* of the thread suction tube 43 by the movement of the thread press member 45*a* of the looper thread presser foot 45 to the press position, as shown in FIG. 8.

When the sewing operation is continued in this state and it reaches the termination position of the fabric W, i.e., on the completion of the sewing operation, putting back on pedal activates the thread cutting device 9 and the movable thread guard member 10 travels forward to the needle location 5.

Upon this, the cut end of the part of the looper thread T2*a* nipped between the movable thread guard member 10 and thread nip member 12 is released. During the time that the movable thread guard member 10 of the thread cutting device 9 travels to the underside of the needle location and picks the looper thread T2, and then retracts to the setting position, that is, after a setting time t4 is elapsed since activation of the thread cutting device 9, the thread press member 45*a* of the looper thread presser foot 45 is released, and the thread suction tube 43 resumes its suction action, so that waste thread (i.e., the opposite ends of the looper thread so cut) is sucked in the thread suction tube 43 and then recovered at a specific location for disposal.

As described above, immediately after the next following sewing operation is started, the part of the looper thread T2*a* hanging between the fabric W and the nip position determined by the movable thread guard member 10 and thread nip member 12, in the vicinity of the setting position on a side of the needle location 5, can be cut under sliding contact at a location extremely adjacent to the starting position of the seams by using the cutting edge 40*a,* facing to the needle location 5, of the blade 40 fixed to the throat plate 4. It is therefore possible to considerably reduce the length of the looper thread end remaining and projecting beyond the starting position of the seams, thereby eliminating the fluff disposal by the operator's manual cutting every time the sewing operation is completed.

By virtue of the cut looper thread disposal means consisting of the thread suction tube 43, thread pick and pull cylinder 44 and looper thread presser foot 45, a plurality of looper threads can be cut collectively and reliably by the stationary blade 40, without falling to cut some of the looper threads. It is also possible that waste thread occurred during the time of this cutting is sucked and collected in the thread suction tube 43 and then recovered at a specific location for disposal.

In the foregoing preferred embodiment, the technique of nipping between the movable thread guard member 10 and thread nip member 12 made of a plate spring is employed as means for nipping and holding the cut end of the looper thread T2, which is cut, immediately after sewing operation is completed, by the thread guard part 10A of the movable thread guard member 10 and the stationary blade member 11. In an alternative, there may be employed other technique using the thread suction tube 43, thread pick and pull cylinder 44, and looper thread presser foot 45, which constitute the cut looper thread disposal means. Specifically, the cut end of the cut looper thread T2 is sucked in the thread suction tube 43, and the thread press member 45*a* of the looper thread presser foot 45 is moved to the press position, as shown in FIG. 8, such that the cut end of the looper thread T2 is nipped and held between the thread press member 45*a* and the internal wall 43*b* of the thread suction tube 43. In this instance, it is unnecessary to provide the thread nip member 12 on the thread cutting device 9 side. In addition, a waste thread disposal means can also function as means for temporarily nipping and holding the cut end.

While the invention has been shown and described in detail, the foregoing description is in all aspects illustrative and not restrictive. It is therefore understood that numerous modifications and variations can be devised without departing from the scope of the invention.

What is claimed is:

1. In a thread cutting device for sewing machine including a thread cutting device that immediately after a sewing operation is completed, cuts a looper thread by pulling it into a setting position located at a side orthogonal to a sewing direction with respect to a needle location of a throat plate, the improvement comprising having a nip means for temporally nipping and holding a cut end of said looper thread cut by said thread cutting device in the vicinity of said setting position, and a blade fixed to said throat plate in such a state that a cutting edge of said blade is faced to said needle location, said blade capable of cutting, under sliding contact, a portion of said looper thread that is hung over between said nip means and a fabric with the feed of fabric immediately after a sewing operation is started in such a state that said cut end is nipped and held by said nip means, and thread cutting device further comprising a cut looper thread disposal means having:

a thread suction device that sucks and holds part of a looper thread cut by said blade at a predetermined position before and after cutting; and a thread pick and pull device that picks said part of said looper thread and pulls it into the vicinity of a suction port of said thread suction device.

2. The thread cutting device for sewing machine according to claim 1 wherein said blade is replaceable by using a blade keeper and setscrew.

3. The thread cutting device for screwing machine according to claim 1 wherein said cutting edge of said blade has a cutting width to allow for slide and tear of said hang portion of said looper thread.

4. In a thread cutting device for sewing machine including:

(i) a movable thread guard member having at its tip a thread guard part that immediately after a sewing operation is completed, travels to the underside of a needle location of a throat plate and picks a looped thread, said movable thread guard member retracting said thread guard part to a side orthogonal to a sewing direction with respect to said needle location and pulling said looper thread picked by said thread guard part into a setting position;

(ii) a stationary blade member for cutting said looper thread pulled into said setting position by said movable thread guard member, under mutually sliding contact action with said thread guard part; and (iii) a thread nip member for nipping the vicinity of a cut end of said looper thread cut by said movable thread guard member and said stationary blade member, between said movable thread guard member and said thread nip member, wherein a blade is fixed to said throat plate in such a state that a cutting edge of said blade is faced to said needle location, said blade capable of cutting, under sliding contact, a portion of said looper thread that is hung over between a fabric and said cut end so nipped with the feed of fabric immediately after a sewing operation is started in such a state that the vicinity of said cut end of said looper thread is nipped between said movable thread guard member and said thread nip member, said thread cutting device further comprises a cut looper thread disposal means having:

a thread suction device that sucks and holds part of a looper thread cut by said blade member at a predetermined position before and after cutting; and a thread pick and pull device that picks said part of said looper thread and pulls it into the vicinity of a suction port of said thread suction device.

5. The thread cutting device for sewing machine according to claim 4, wherein a plurality of said needle locations in said throat plate are disposed in parallel in a direction orthogonal to a sewing direction, and a plurality of loopers corresponding to said needle locations, respectively, are reciprocally movable in said direction.

6. The thread cutting device for sewing machine according to claim 4 wherein said blade is replaceable by using a blade keeper and setscrew.

7. The thread cutting device for sewing machine according to claim 2 wherein said cutting edge of said blade has a cutting width to allow for slide and tear of said hang portion of said looper thread.

8. The thread cutting device for sewing machine according to claim 6 wherein said cutting edge of said blade has a cutting width to allow for slide and tear of said hang portion of said looper thread.

9. The thread cutting device for sewing machine according to claim 4 wherein said cutting edge of said blade has a cutting width to allow for slide and tear of said hand portion of said looper thread.

* * * * *